US005941183A

United States Patent [19]

Ming-Shun

[11] Patent Number: 5,941,183

[45] Date of Patent: Aug. 24, 1999

[54] LIGHT WEIGHT PORTABLE COMBINATION TABLE STRUCTURE FOR EXHIBITION USE

[75] Inventor: Yang Ming-Shun, Taipei, Taiwan

[73] Assignee: Formosa Saint Jose, Corp., Taipei, Taiwan

[21] Appl. No.: 09/092,303

[22] Filed: Jun. 5, 1998

[51] Int. Cl.[6] ..... A47B 3/06

[52] U.S. Cl. ..... 108/153.1; 108/158.11; 108/190

[58] Field of Search ..... 100/153.1, 158.11, 100/192, 180, 190, 158.12, 157.1, 90

[56] References Cited

U.S. PATENT DOCUMENTS

| | | | |
|---|---|---|---|
| 3,851,601 | 12/1974 | Davis | 108/158.11 |
| 4,630,550 | 12/1986 | Weitzman | 108/158.11 X |
| 5,158,187 | 10/1992 | Taub | 108/192 X |
| 5,218,914 | 6/1993 | Dickinson | 108/192 X |
| 5,579,703 | 12/1996 | King | 108/158.11 X |
| 5,628,257 | 5/1997 | Conner et al. | 108/158.12 |
| 5,706,741 | 1/1998 | Thorp et al. | 108/153.1 X |
| 5,711,230 | 1/1998 | Parsons | 108/153.1 X |
| 5,802,990 | 9/1998 | Lin | 108/157.1 |

*Primary Examiner*—Jose V. Chen
*Attorney, Agent, or Firm*—Erik M. Arnhem

[57] ABSTRACT

A table top structure, especially for use in exhibition booths, can include a sectional table top supported by a knock-down support framework that includes vertical pipes and horizontal pipes connected together by tubular sockets. Each socket has plural radial projections for telescopic insertion into the horizontal pipes. The table structure can include vertical partitions that may be either rigid panels or flexible fabric panels.

4 Claims, 7 Drawing Sheets

LIGHT WEIGHT PORTABLE COMBINATION TABLE STRUCTURE FOR EXHIBITION USE

BACKGROUND OF THE INVENTION

Manufacturers normally attend exhibitions around the world in order to advertise their products. As a general practice, the exhibitions will pre-arrange varied size of the exhibition booths for the manufacturers to choose from. The manufacturers then, based on the shape and size of the booth, arrange their exhibits. Because the tables and racks provided by the exhibitions are fixed in sizes and shapes, it is difficult for the exhibitors to exhibit their products with their original idea. This will significantly influence the effects of the exhibits. It is also impossible for the exhibitors to carry the big and inseparable tables to the worldwide exhibitions. This is a problem for to the manufactures that attend exhibitions frequently.

Due to the inconvenience of the conventional exhibition tables, the inventor therefore conceived the present invention to provide a light weight portable combination table structure to allow exhibitors to design their own exhibition tables according to the fixed spaces of the exhibitions. This allows the exhibitors to make the best use of their exhibition spaces. While not in use, the dismantled table structures can be stored in small storage space so as to be easily portable. For the manufactures that attend exhibitions frequently, this is a very convenient product that serves their needs.

SUMMARY OF THE INVENTION

The present invention includes two pieces of plastic corrugated sheets, four cocks, four first sockets, four vertical pipes, four second sockets, four struts, some crosswise pipes, and some fixedness parts. The plastic corrugated sheets have parallel holes and inserts arranged in order on cross section sides. Inside the first and second pipe sockets there is a circular flange, outside of these two sockets there are at least two bulges in the shape of a cross. Outside of the connection parts there are multiple fixed clips in the shape of a cross. Through these different parts, users can assemble a combination table in varies sizes and shapes.

DETAILED DESCRIPTION

Figure 1:
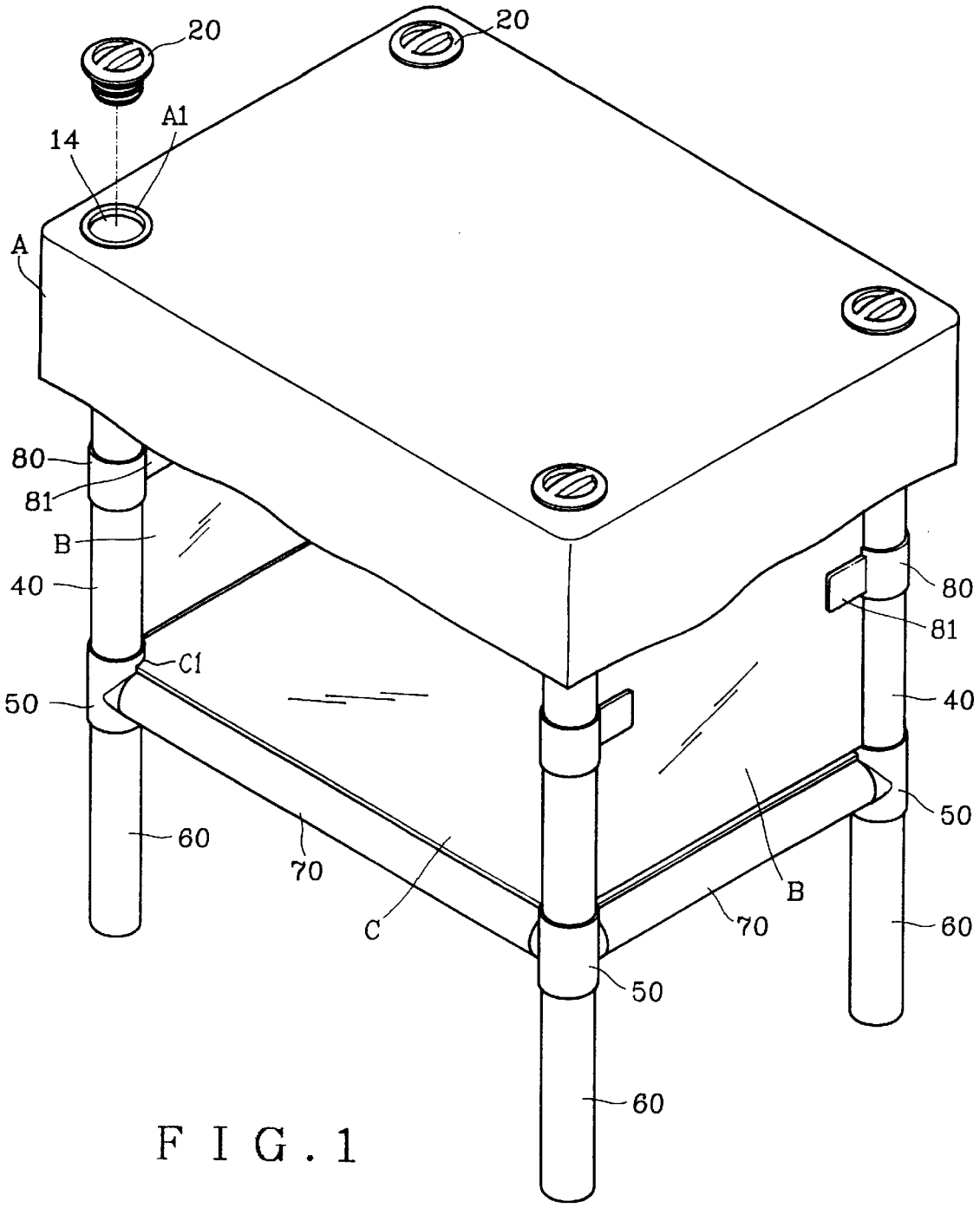
FIG. 1 shows the portable combination table of this invention in perspective.
Figure 2:
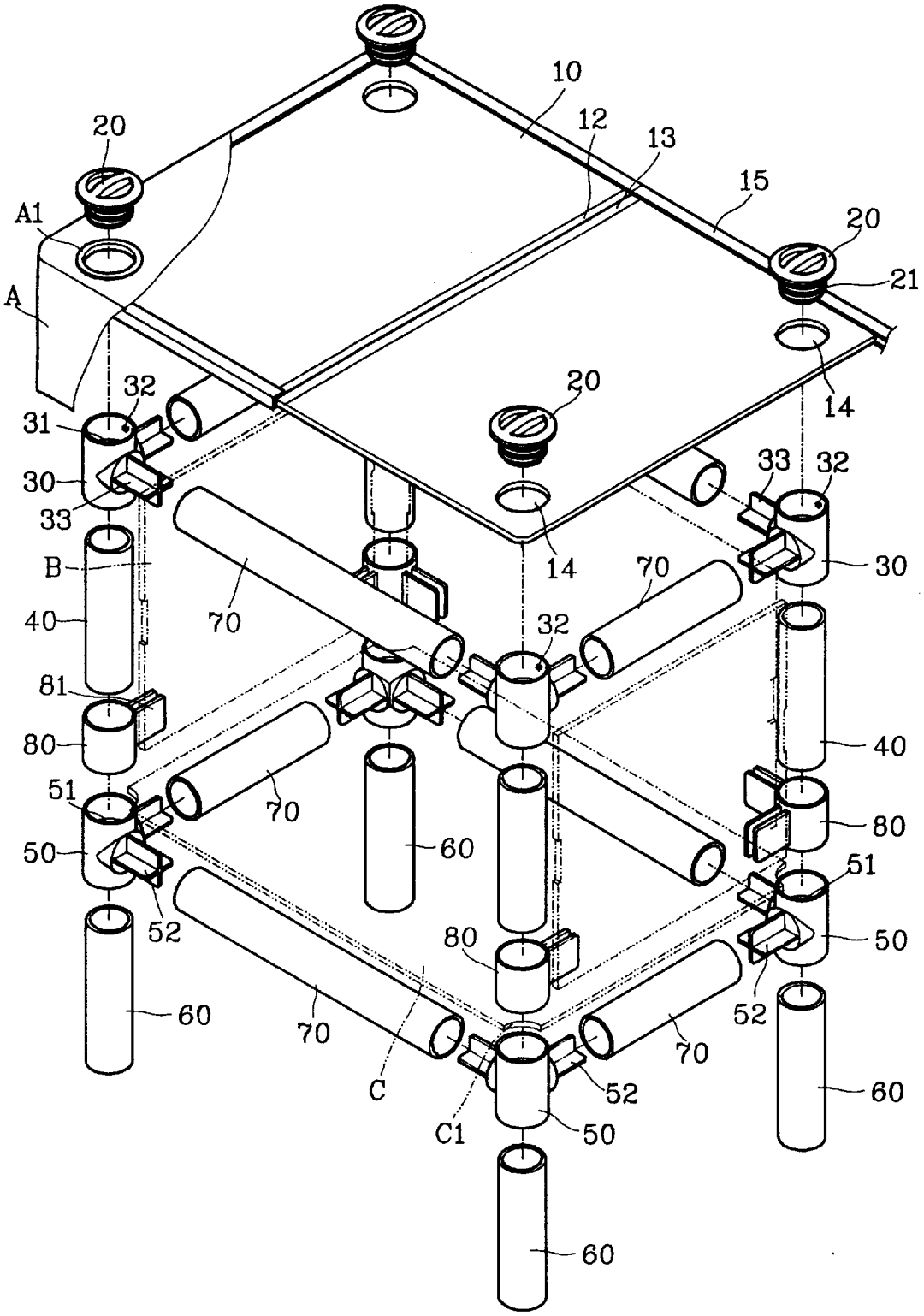
FIG. 2 is an exploded view of the portable combination table of this invention.

Referring to FIGS. 1 and 2, the portable combination table according to this invention includes two similar plastic hollow sheets (10), four threaded plugs (20), four first pipe sockets (30), four vertical pipes (40), four second pipe sockets (50), four tubular struts (60), multiple crosswise pipes (70), multiple sleeves (80), multiple vertical partitions (B), and multiple horizontal partitions (C).

Figure 3:
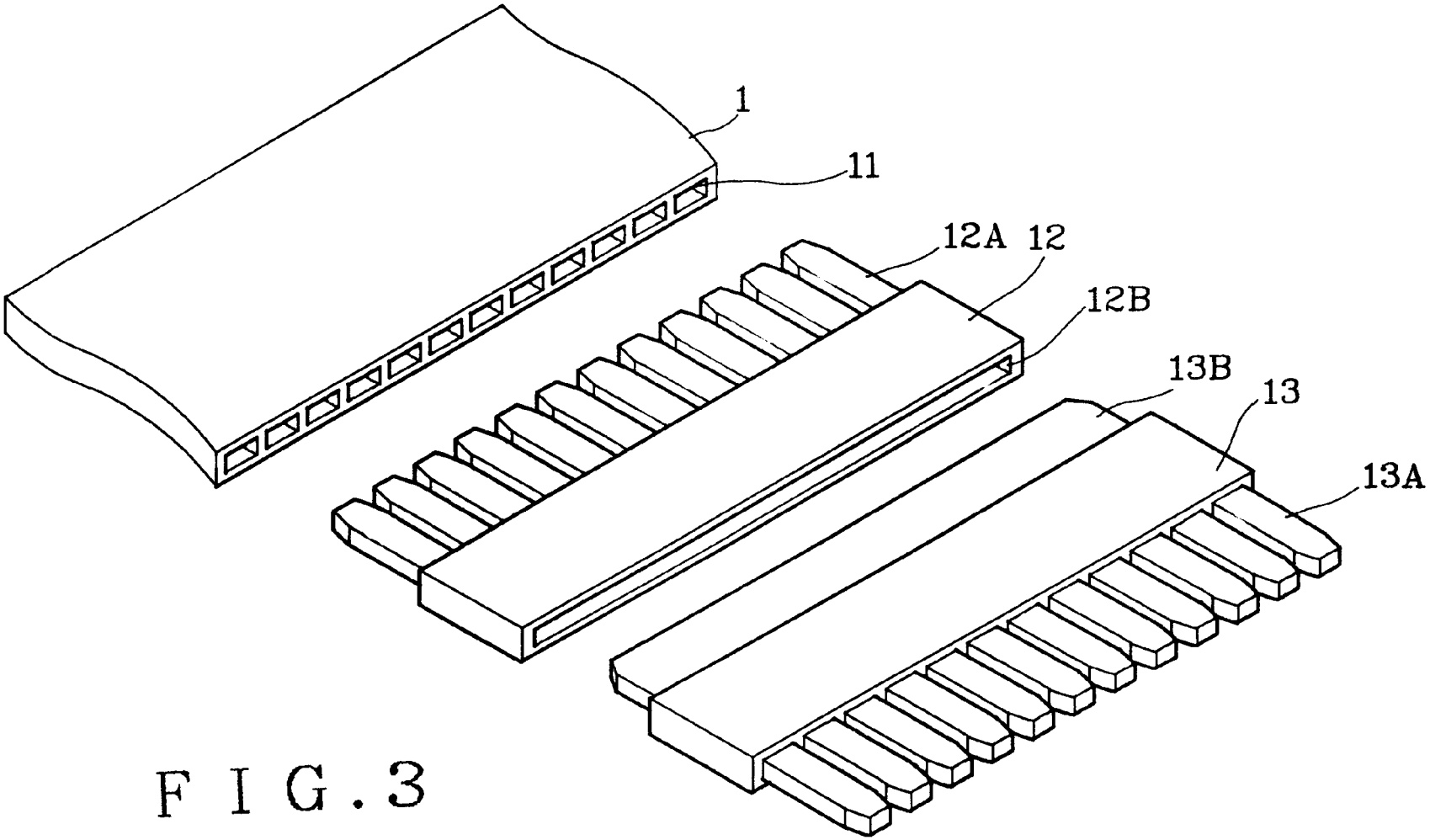
FIG. 3 is an exploded view of a sectional table top used in the FIG. 1 table.

Referring to FIGS. 1 and 3, two same size plastic hollow sheets (10) have parallel holes (11) on the cross section, whereby the prongs (12A) and (13A) of the left connective plank (12) and the right connective plank (13) can be inserted into the holes to combine the hollow sheets with the connective planks. The long fillister (or slot) (12B) on the opposite hand side of the left connective plank (12) is combined with the long fin (13B) on the opposite hand side of the right connective plank (13), using this connection to tie two pieces of the plastic hollow sheet (10) to form a tabletop.

The tabletop can further include an ornamental rim 15 extend around an edge of the sectional top assembly. The table-top can be connected to the supporting framework by means of four threaded plugs 20 and fourassociated sockets 30. Holes 14 at corner areas of the table top are aligned with openings in tablecloth A, whereby plugs 20 can be inserted through the holes and aligned openings into the sockets 30.

Plugs 20 are threaded into sockets 30 to clamp the table top and tablecloth between the flanges on plugs 20 and the sockets. An ornamental plastic washer A1 can be located underneath the flange of each plug 20.

Figure 4:
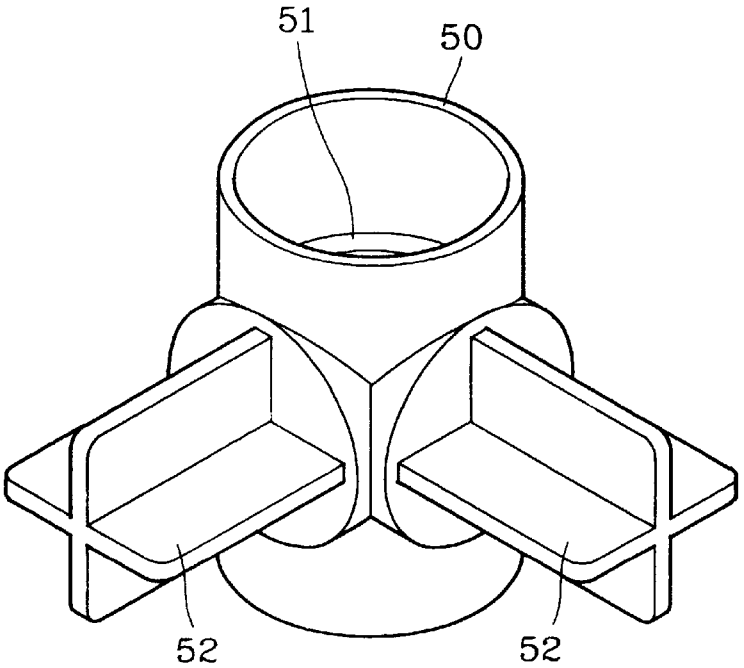
FIG. 4 shows a pipe socket used in practice of the invention.

Referring to FIGS. 1, 2, and 4, sockets 30 are telescoped onto the upper ends of vertical pipes 40. The lower end of each vertical pipe is telescoped into a lower socket 50 that has an internal flange 51 for limiting the insertional movement of the pipe.

Tubular struts 60 have their upper ends telescoped into collars 50, whereby the struts 60 and vertical pipes 40 collectively form support legs for the tabletop. Each socket 30 or 50 has plural projections 33 or 52 extending radially away from the socket axis to form a mechanism for connecting the vertical support members (40,60) to horizontal pipes 70. Each projection 33 or 52 has a cross shape for easy telescopement into the end of an associated pipe 70.

Figure 5:
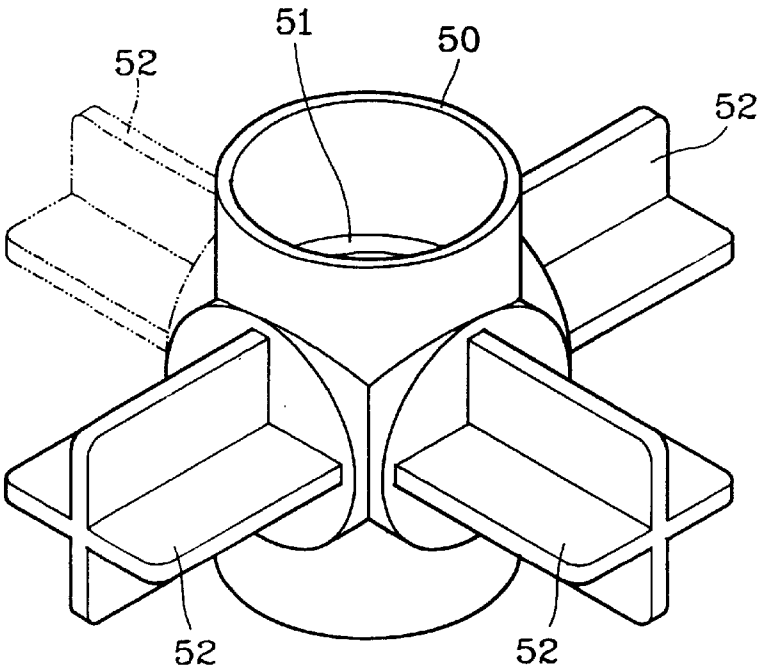
FIG. 5 shows a pipe socket used in practice of the invention.
Figure 8:
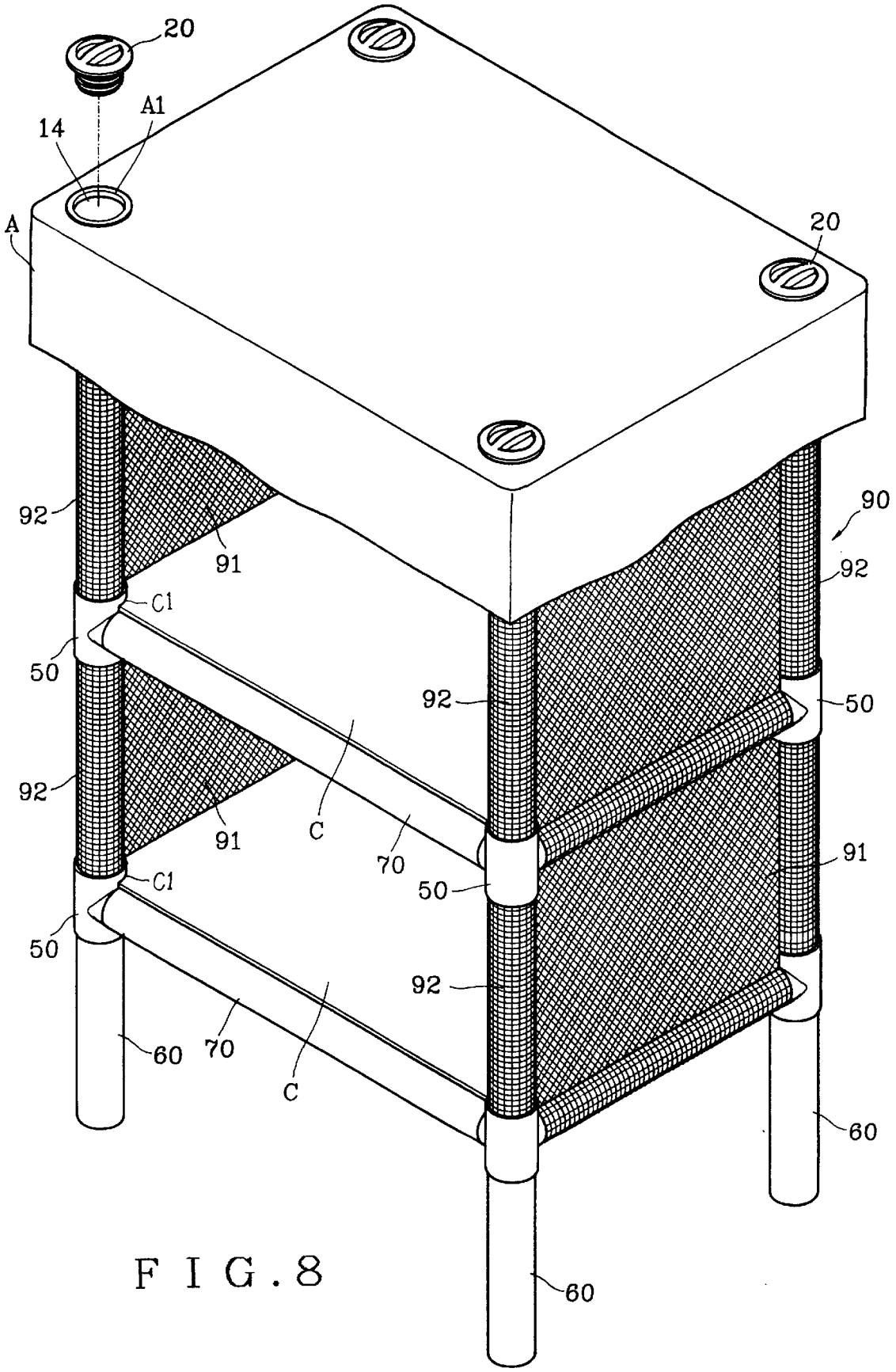
FIG. 8 shows a second embodiment of the invention.
Figure 9:
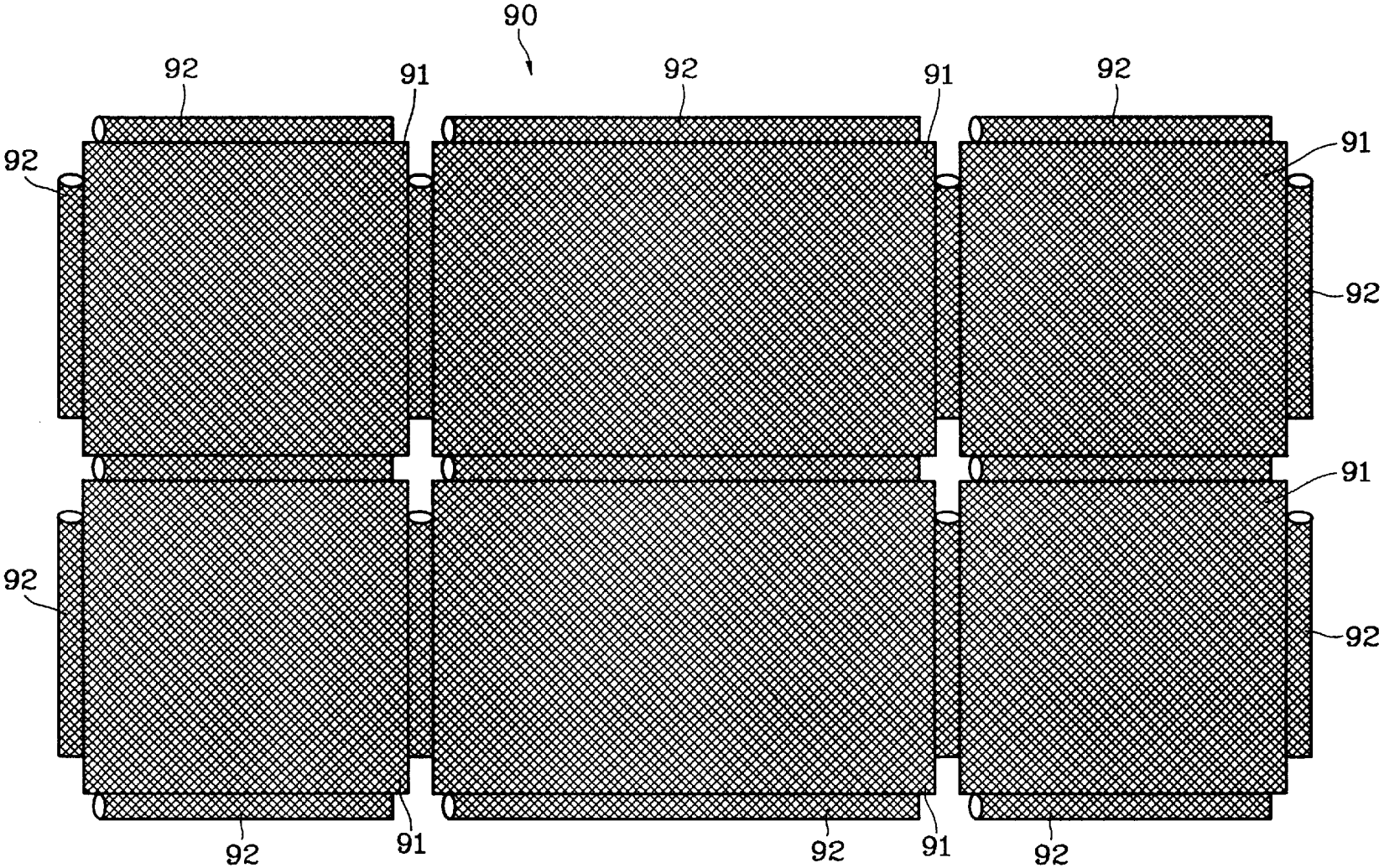
FIG. 9 shows a further embodiment of the invention.

Projections 33 and 52 are spaced circumferentially around the respective socket surface at ninety degree increments. The number of projections is related to the number of tables in the system. FIGS. 1, 2, and 8 show a single table. FIG. 9 shows a system comprised of a number of tables linked together. FIG. 4 shows a socket structure used for a single table. FIG. 5 shows a socket structure usable when plural tables are to be linked together.

The pipe system is designed to support horizontal partitions C and vertical partitions B. As shown in FIGS. 1, and 8, horizontal partitions C are flat rectangular panels having concave cut-outs C1 at their corners, whereby the corner areas mate with the sockets 50 that connect the vertical pipes and tubular struts 60. FIG. 1 shows a table having a single horizontal partition. FIG. 8 shows a table having two horizontal partitions.

The vertical partitions can be flat panels, as shown at B in FIGS. 1 and 2; alternately the vertical partitions can be formed of a fabric net material, as shown at 90 in FIGS. 8 and 9. FIG. 9 further shows the horizontal partitions as being formed of a net material.

Figure 6:
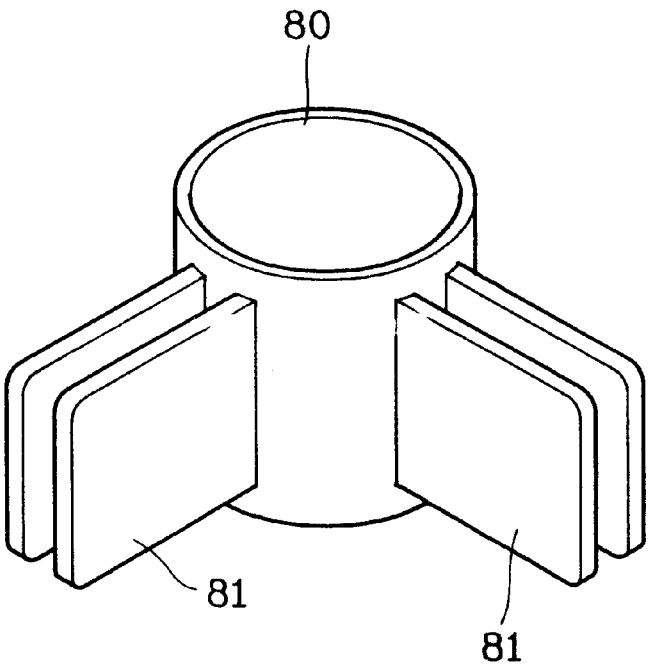
FIG. 6 shows a partition connector means used in practice of the invention.
Figure 7:
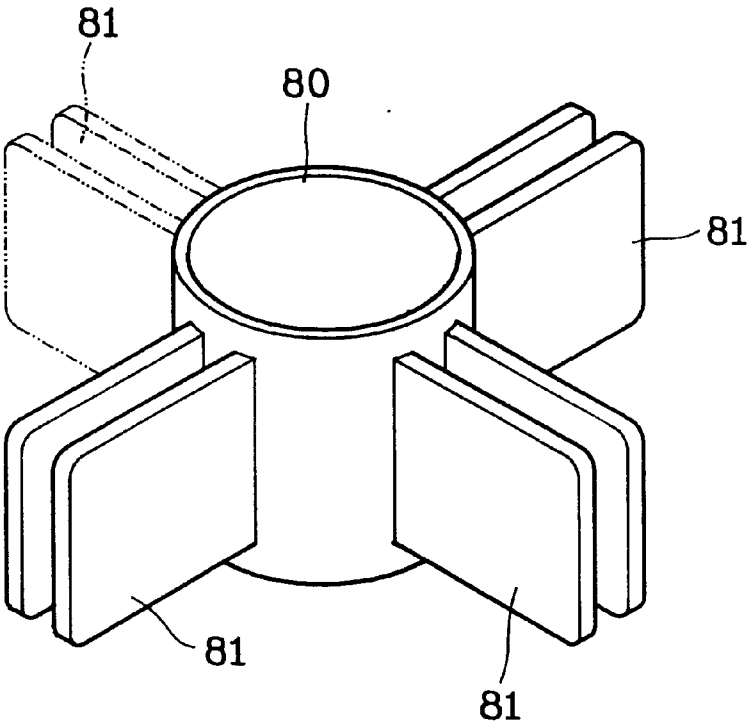
FIG. 7 shows another partition connector means used in practice of the invention.

FIGS. 6 and 7 show connectors that can be used to connect the vertical partitions of FIGS. 1 and 2 to the vertical pipes 40. Each connector comprises a sleeve 80, having plural slotted clips 81 extending radially away from the sleeve axis. The clips 81 are spaced circumferentially at ninety degree increments. ninety degree increments.

As shown in FIG. 1, sleeves 80 encircle vertical pipes 40 at intermediate points along the pipe length; the slotted clips

81 embrace the vertical partitions B to retain the partitions vertically between adjacent ones of the vertical pipes.

The vertical fabric partitions 30, shown in FIG. 8, comprise fabric (net material) panels 91 having edge areas that are formed into loops or tubes 92. Each tube is telescoped onto an associated pipe 40 or 70, whereby the fabric partitions are oriented vertically.

The table support framework 40,70 is designed so that the vertical partitions can either be rigid panels (as shown in FIG. 1) or net fabric units (as shown in FIG. 8).

What is claimed is:

1. A table structure comprising:

a table top, a tablecloth for said top, a supporting framework for said top, and partition means supported by said framework;

said table top comprising two hollow sheets (10) and two planks (12,13) connecting said hollow sheets, each said plank having parallel prongs telescoped into one of said hollow sheets to form a sectional table top;

said table top having four corners, and a hole near each corner; said tablecloth having openings aligned with said holes;

said framework comprising four upper sockets (30) located underneath said table top in alignment with said holes, and flanged threaded plugs (20) extending through said holes and openings into said upper sockets, whereby the tabletop and tablecloth are clamped to said sockets;

said framework further comprising four vertical pipes (40) having upper ends thereof telescoped into said upper sockets, four lower sockets (50) telescopically receiving the lower ends of said vertical pipes, and four vertical tubular struts (60) having upper ends thereof telescoped into said lower sockets;

each said socket having plural cross-shaped projections (33,52) spaced around the socket circumference; and upper and lower horizontal pipes (70) extending between selected ones of said sockets in an orthogonal arrangement, each said horizontal pipe having opposite ends thereof telescoped onto selected ones of the aforementioned cross-shaped projections;

said partition means comprising a horizontal partition supported on the lower horizontal pipes.

2. The table structure of claim 1, wherein said planks are joined together by means of a slot in one plank and a fin on the other plank; said fin being telescoped into said slot to join the two planks together.

3. The table structure of claim 1, wherein said partition means further comprises vertical partitions extending between selected ones of said vertical pipes; and means connecting edge areas of said vertical partitions to the associated vertical pipes; each said connecting means comprising a sleeve (30) encircling an associated vertical pipe and a slotted clip (8) extending from said sleeve to embrace an edge area of an associated partition.

4. The table structure of claim 1, wherein said partition means further comprises vertical partitions extending between selected pipes; each vertical partition comprising a fabric panel (91) having four edges and a fabric tube (92) extending along each edge of the fabric panel; said fabric tubes being telescoped onto selected pipes to attach the vertical partitions to the supporting framework.

* * * * *